US007810809B2

(12) United States Patent
Inui

(10) Patent No.: US 7,810,809 B2
(45) Date of Patent: Oct. 12, 2010

(54) SHEET CONVEYING APPARATUS AND IMAGE FORMING APPARATUS

(75) Inventor: Fumiki Inui, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 603 days.

(21) Appl. No.: 11/748,094

(22) Filed: May 14, 2007

(65) Prior Publication Data

US 2007/0273092 A1 Nov. 29, 2007

(30) Foreign Application Priority Data

May 26, 2006 (JP) ..... 2006-147173

(51) Int. Cl.
*B65H 9/16* (2006.01)

(52) U.S. Cl. ..... 271/250; 271/248; 271/251

(58) Field of Classification Search ..... 271/226, 271/248–251

See application file for complete search history.

(56) References Cited

U.S. PATENT DOCUMENTS

| | | | | |
|---|---|---|---|---|
| 4,809,968 | A * | 3/1989 | Malachowski | 271/251 |
| 5,080,345 | A * | 1/1992 | Daniels | 271/239 |
| 5,092,579 | A * | 3/1992 | Tokoro et al. | 271/240 |
| 5,286,018 | A * | 2/1994 | Rasmussen et al. | 271/147 |
| 5,379,998 | A * | 1/1995 | Nakagawa | 271/248 |
| 5,957,598 | A * | 9/1999 | Berkers et al. | 400/630 |
| 6,032,949 | A * | 3/2000 | Ando | 271/225 |
| 6,671,488 | B2 | 12/2003 | Izawa et al. | 399/329 |
| 6,993,282 | B2 * | 1/2006 | Kimizuka | 399/401 |
| 7,130,572 | B2 | 10/2006 | Kubochi et al. | 399/329 |
| 7,571,908 | B2 * | 8/2009 | Inui et al. | 271/251 |
| 7,637,499 | B2 * | 12/2009 | Kawashima et al. | 271/240 |
| 7,641,191 | B2 * | 1/2010 | Inui | 271/251 |
| 2007/0222144 | A1 * | 9/2007 | Inui et al. | 271/291 |

FOREIGN PATENT DOCUMENTS

JP 2004-299856 10/2004

* cited by examiner

*Primary Examiner*—Patrick Mackey
*Assistant Examiner*—Patrick Cicchino
(74) *Attorney, Agent, or Firm*—Fitzpatrick, Cella, Harper & Scinto

(57) ABSTRACT

An image forming apparatus in which with a guide surface that is disposed upstream of a reference guide and is oblique so as to come close to a central portion in a width direction orthogonal to a sheet conveying direction of a re-conveying path as it extends from upstream to downstream, a sheet having been conveyed with deviated on the opposite side to the central portion side in the re-conveying path from a reference surface of the reference guide, is guided while being changed its orientation to the direction of the reference guide side. Furthermore, with a guide portion disposed along the guide surface, there is formed with respect to the guide surface a space acting to flex an edge portion of the sheet when the sheet is contacted with the guide surface.

8 Claims, 11 Drawing Sheets

SHEET CONVEYING APPARATUS AND IMAGE FORMING APPARATUS

BACKGROUND OF THE INVENTION

1. Field of the Invention

The present invention relates to a sheet conveying apparatus and an image forming apparatus and, more particularly to a width directional positioning of a sheet when the sheet of which one side an image is formed on is reversed, and conveyed to an image forming portion again to form an image on the backside of the sheet.

2. Description of the Related Art

Conventionally, in image forming apparatuses such as electrophotographic printers, there has been the one, which reverses a sheet on which an image has been formed on the first side, conveys the sheet to the image forming portion again, and thereby forms an image on the second side of the sheet. Furthermore, in an image forming apparatus capable of forming an image on both sides of a sheet like this, there is provided a sheet conveying apparatus in which a sheet on which one side an image has been formed on one side is reversed and conveyed to an image forming portion again.

Here, in such a conventional sheet conveying apparatus, in the case where a sheet is conveyed to an image forming portion again in order to form an image on the second side, the sheet may be skew-fed (conveyed in an oblique state), or fed while deviated in a width direction (in a direction orthogonal to a sheet conveying direction). Due to this skew feed or positional deviation of a sheet, when an image is formed on the second side, the position of an image with respect to the sheet is deviated. The cause of such a skew feed or positional deviation is that in the case of forming an image on the second side, a conveying path comes to be longer as compared with the case on the first side, thus being largely affected by the eccentricity or the difference in an applied pressure of each of a plurality of rollers disposed in a conveying direction for conveying the sheet, the difference in resistance on a conveying surface or the like.

Then, to prevent such a deviation of a sheet, after an image has been formed on the first side, the position of the sheet needs to be adjusted so that the sheet is registered with respect to an image on the way of conveyance until the image is formed on the second side. Thus, as such a sheet position adjusting method, there is a method which disposes a reference guide at one end portion of a re-conveying path conveying the sheet of which the first side an image has been formed on, and conveys the sheet while pressing the sheet against this reference guide, thereby making the positioning in a width direction of the sheet (lateral registration correction).

FIG. 8 is a view taken from above illustrating the construction of a sheet conveying apparatus making the positioning in a width direction (lateral registration correction) of a sheet S by such a so-called one-side reference.

With reference to FIG. 8, a reference guide 12 is disposed at one end portion of a re-conveying path 18. By pressing one side edge parallel with a sheet conveying direction of the sheet S against a reference surface 12*a*, 12*b* of this reference guide 12, the position of a side edge of the sheet S is adjusted. The end portion of the sheet S is pressed against one of the reference surfaces 12*a* and 12*b* for positioning, depending on the size of a sheet. A conveying lower guide 20 forms a lower surface of the re-conveying path 18 along with the reference guide 12.

Roller shafts 13 of two oblique-feed rollers 11*a* are held rotatably with respect to the reference guide 12 by bearings respectively. Further, respective pulleys 15 are fixed to the end portions of two roller shafts 13, and these two roller shafts 13 are driven by belts 16*a* and 16*b* passed over these pulleys 15. One belt 16*a* of these belts 16*a* and 16*b* is driven by a driving motor (not shown), and thus the oblique-feed rollers 11*a* are driven by this driving motor.

Moreover, a pin 17 rotatably holds an oblique-feed driven rotatable member 11*b*, as well as being supported by a conveying upper guide 19 illustrated in the below-described FIG. 1 that forms an upper surface (top surface) of the re-conveying path 18. A spring 181 presses the pin 17 from above. By the action of this spring 181, the oblique-feed driven rotatable member 11*b* is brought into pressure contact with the oblique-feed roller 11*a* under a predetermined pressure.

Furthermore, in the re-conveying path 18 adjusting the side edge position of a sheet S by the one-side reference, a sheet S of which the first side an image is formed on, and thereafter the sheet S being conveyed from the direction indicated by an arrow A is oblique-fed by the oblique-feed rollers 11*a* and the oblique-feed driven rotatable members 11*b*.

Here, these oblique-feed driven rotatable members are oblique at a predetermined angle respectively so as to apply a conveying force toward a reference surface 12*a*, 12*b* to a sheet S in order to abut the sheet S on the reference surface. Whereby, the sheet S is conveyed while changing the orientation of the sheet S to be directed toward the reference surface side, and thus an end portion thereof is pressed against the reference surface 12*a*, 12*b*, thereby performing a positioning of the sheet S.

Incidentally, owing to a longer conveying path as described already, the eccentricity or the difference in an applied pressure of various rollers, the difference in resistance of a conveying surface or the like, there are some cases where the skew feed of a sheet S occurs until the sheet is conveyed to the re-conveying path 18. Also, a curl may occur at an end portion of the sheet after an image fixation.

Thus, conventionally, for example, as illustrated in FIG. 8, reference guide introducing portions 12*c*, 12*d* having a rake angle are formed at the reference surface 12*a*, 12*b*. Further, there is the one in which a sheet having been skew-fed is rotated in a thrust direction by a rake angle of these reference guide introducing portions 12*c* and 12*d*. This art is disclosed in Japanese Patent Application Laid-Open No. 2004-299856.

Here, as illustrated in FIG. 8, in the case where a sheet S is conveyed being deviated by X1 in the direction indicated by an arrow X, which is a thrust direction from the reference surface 12*a*, first a leading edge of this sheet S, as illustrated in FIG. 9A, is contacted a side end surface of the reference guide introducing portion 12*c* having a rake angle.

Here, since there is no conveying roller nip in the upstream vicinity of the reference guide introducing portion 12*c*, the sheet leading edge can rotate in the thrust direction. Whereby, thereafter, when conveyed in the direction indicated by an arrow B, the sheet S, as illustrated in FIG. 9B, due to the rigidity (stiffness) of a sheet leading edge, the sheet leading edge is slid along the reference guide introducing portion 12*c* without buckling, and then the leading edge of the sheet S is rotated in the Rx direction. Then, the leading edge of the sheet S is conveyed along the reference guide introducing portion 12*c*.

Subsequently, the sheet S having been rotated in the Rx direction like this, thereafter, as illustrated in FIG. 9C, by the action of the oblique-feed roller 11*a* and the oblique-feed driven rotatable member 11*b*, is pressed against the reference surface 12, and fed to the image forming portion again while being positioned.

Like this, a sheet S having been conveyed being deviated by X1, is raked X1 by the reference guide introducing portion 12*c* to come close to the reference surface 12*a* while being rotated in the Rx direction, and thereafter fed to the image forming portion again while being positioned by the action of the oblique-feed roller 11*a* and the oblique-feed driven rotatable member 11*b*.

By the way, in such a conventional sheet conveying apparatus and image forming apparatus, in order that a sheet leading edge can be rotated in the Rx direction, as illustrated in FIG. 10, there is formed a gap GA between a bottom surface on the opposite side to the reference guide 12 of the conveying lower guide 20 and a sheet S. Whereby, when the leading edge of the sheet S is made to come close to the central side by degrees, and thus the sheet is twisted with the reference guide introducing portion 12*c*, a portion on the opposite side to the reference surface 12*a* of the sheet S can be flexed in the gap GA, thus enabling the sheet S to rotate in the Rx direction.

When, however, a deviation amount X1 of a sheet S becomes larger, the amount of flexure of the sheet S when the sheet S is twisted gets larger, resulting in a higher rigidity of the sheet. Therefore, the sheet cannot be sufficiently flexed in the gap GA, and thus the rotation of the sheet S may be limited. In this case, a sheet leading edge on the reference guide introducing portion 12*c* side, as illustrated in FIG. 11, will be buckled on the side end surface of the sheet guiding portion 12*c*. As a result, a sheet S cannot be rotated in the Rx direction, and thus a skew feed cannot be sufficiently corrected or a buckled sheet end portion comes to be a conveying resistance, resulting in the occurrence of a sheet jam. In particular, the higher the rigidity of a sheet S is, the higher the rigidity when the sheet is twisted is, so that a buckling of the sheet leading edge on the reference guide introducing portion 12*c* side is likely to occur.

Like this, when a deviation amount X1 of a sheet S gets larger, when a sheet leading edge is contacted with a side end surface of the reference guide introducing portion 12*c*, the sheet leading edge is buckled, resulting in the occurrence of a sheet jam. Accordingly, when a deviation amount X1 in a thrust direction of the sheet S is raked up to the reference guide 102 with the reference guide introducing portion 12*c*, the rigidity of the sheet S needs to be not more than such a magnitude as allows the sheet to sufficiently flexed at a place of the gap GA.

On the other hand, in the case of a thin sheet S, or in the case of a low rigidity of the sheet S as is under high-humidity environments, when a deviation amount X1 of the sheet S gets larger, upon a sheet leading edge being contacted with the reference guide introducing portion 12*c*, the sheet leading edge is likely to buckle as illustrated in FIG. 11. As a result, the sheet S cannot be rotated in the Rx direction, and further the sheet end portion having been buckled becomes a conveying resistance, resulting in the occurrence of a sheet jam.

Furthermore, with a sheet having been curled at a leading edge portion after fixing, since the sheet is further curled when the sheet leading edge is contacted with a side end surface of the sheet guiding portion 12C, resultingly there will be a corner folding at the leading edge of the curled sheet, and thus a sheet jam is likely to occur.

That is, depending on the magnitude of rigidity of a sheet S or due to a curl occurring at the sheet S, when being conveyed along the reference guide introducing portion 12*c*, the sheet cannot change the direction thereof toward the reference guide, and thus a sheet leading edge portion may be buckled. Then, when the sheet leading edge portion is buckled like this, this buckled portion comes to be a conveying resistance, resulting in the occurrence of a sheet jam in the vicinity of the reference guide introducing portion.

SUMMARY OF THE INVENTION

Then, the present invention has been made in view of such conditions, and has an object of providing a sheet conveying apparatus and an image forming apparatus with which even in the case where a sheet is conveyed being deviated, positioning in a width direction of the sheet and conveyance of the sheet can be reliably performed.

The present invention is an image forming apparatus including:

a reference guide disposed in a conveying path of a sheet, and including a reference surface extending in a sheet conveying direction;

an oblique-feed mechanism configured to oblique-feed a sheet to abut a side edge of the sheet on the reference surface;

a guide surface disposed upstream of the reference guide configured to guide the conveyed sheet toward the reference guide and the guide surface is oblique so as to come close to a central portion in a width direction orthogonal to a sheet conveying direction of the conveying path as the guide surface extends from upstream to downstream; and a guide portion provided along the guide surface, and disposed so as to come close to the guide surface as the guide portion extends from upstream to downstream.

Further features of the present invention will become apparent from the following description of exemplary embodiments with reference to the attached drawings.

DESCRIPTION OF THE EMBODIMENTS

Figure 1:
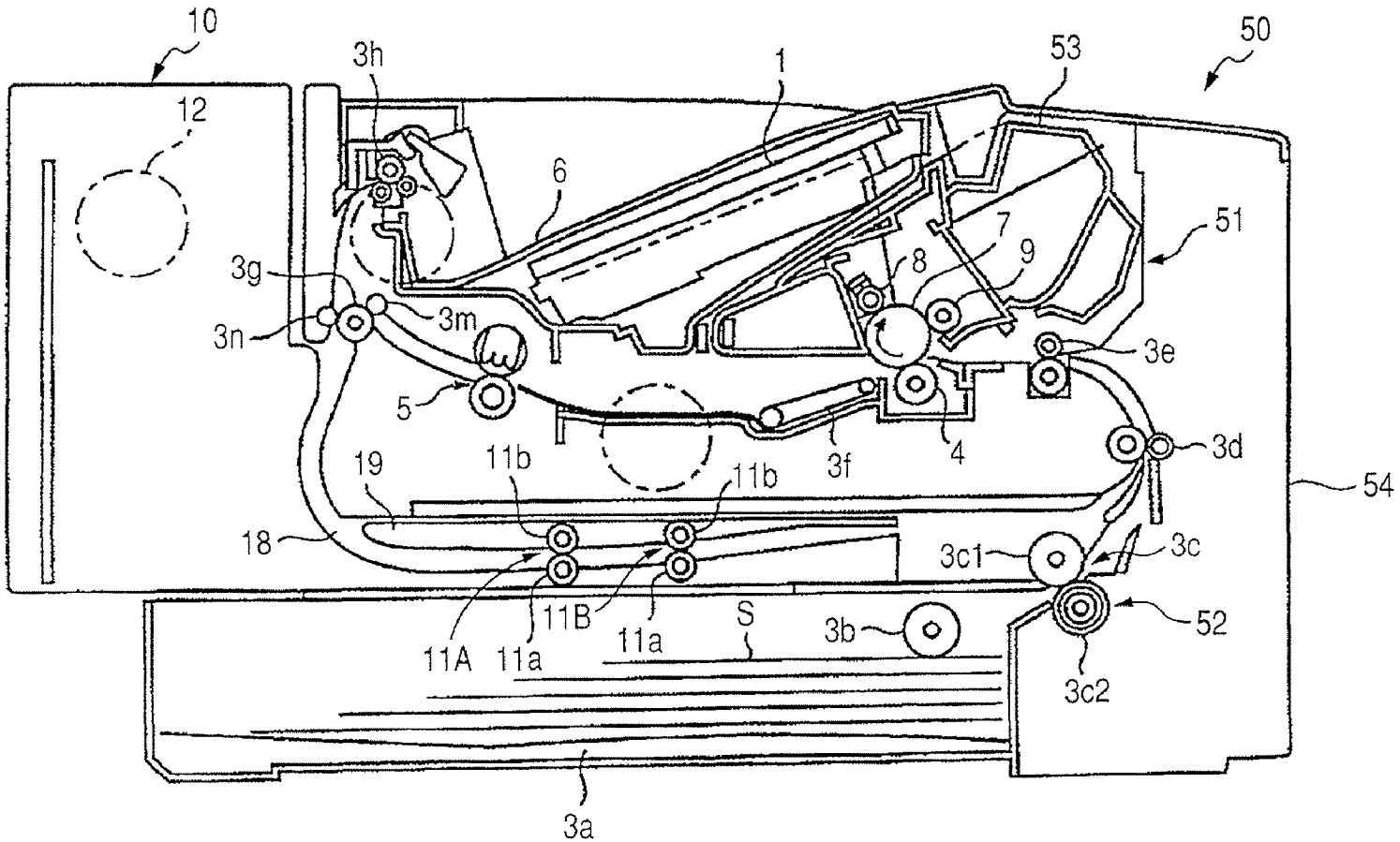
FIG. 1 is a view illustrating a schematic construction of a laser beam printer, being one example of an image forming apparatus provided with a sheet conveying apparatus according to an embodiment of the present invention.

Hereinafter, an exemplary embodiment for carrying out the present invention will be described in detail referring to the drawings.

FIG. 1 is a view illustrating a schematic construction of a laser beam printer, being one example of an image forming apparatus provided with a sheet conveying apparatus according to an embodiment of the present invention.

With reference to FIG. 1, a laser beam printer 50 forms an image by an electrophotographic printing method. This laser beam printer 50 is provided with an image forming portion 51 forming an image, and a feeding portion 52 separating and feeding a sheet S one by one to the image forming portion 51. Further, this laser beam printer 50 is provided as an optional equipment with a duplex unit 10 with which to allow for forming images on both sides of a sheet S, an image is formed on a first side (on one side), and thereafter a sheet S is conveyed to the image forming portion 51 again to form an image on a second side (on the backside).

Here, the image forming portion 51 is provided with a process cartridge 53 and a transfer roller 4. The feeding portion 52 is provided with a paper feed cassette 3*a* stacking sheets S therein, a pick-up roller 3*b*, and a pair of separation rollers 3*c* including a feed roller 3*c*1 and a retard roller 3*c*2. Note that, the process cartridge 53 includes integrally a photosensitive drum 7, a charging roller 8 uniformly charging the surface of the photosensitive drum, a developing unit 9 developing an electrostatic latent image formed on the photosensitive drum and the like, and is removable with respect to a laser beam printer main body (hereinafter referred to as an apparatus main body) 54.

Moreover, a duplex unit 10 includes a lateral registration correction unit to be described below provided with a re-conveying path 18 and a pair of oblique-feed rollers 11A and 11B having oblique-feed rollers 11*a* and 11*b*. In FIG. 1, a reference numeral 1 denotes a laser scanner unit, 5; a fixing unit, and 6; a discharge tray.

Now, an image forming operation of the laser beam printer 50 thus constructed is described.

When an image information is transmitted to a controller (not shown) from a personal computer (not shown), the image information is subjected to an image forming processing at the controller, and thereafter a print signal is output from the controller, first, the photosensitive drum 7 is rotated in the direction indicated by an arrow to be uniformly charged at a predetermined polarity and at a predetermined electric potential by the charging roller 8. Then, with respect to the photosensitive drum 7 after having been charged on the surface like this, a laser beam is irradiated based on the image information from a laser scanner unit 1, whereby an electrostatic latent image is formed on the photosensitive drum 7. Next, this electrostatic latent image is developed by the developing unit 9 to be visualized as a toner image.

On the other hand, in parallel with such a toner image forming operation, sheets S stacked and contained in the paper feed cassette 3*a* are fed out by a pick-up roller 3*b*, and thereafter separated and conveyed by a pair of separation rollers 3*c*. Further, thereafter, the sheets are conveyed to the transfer portion including the photosensitive drum 7 and a transfer roller 4 by a pair of conveying rollers 3*d* and 3*e*.

In addition, at this time, a leading edge of the sheet S is detected by a registration sensor (not shown) provided upstream of the transfer portion. Based on a detection signal from this registration sensor, the controller synchronizes light emission timing from the laser scanner unit 1 with a leading edge position of the sheet S. Whereby, a toner image formed on the photosensitive drum can be transferred in a predetermined position on the Sheet S.

Subsequently, the sheet S on which a toner image has been transferred like this is fed to a fixing unit 5 along a conveying belt 3*f*, and by being heated and pressurized when passing through this fixing unit 5, the toner image will be fixed semi-permanently.

Here, in the case where a sheet S is formed with an image only on one side, the sheet S having passed the fixing unit 5 is fed to a nip between a conveying roller 3*g* capable of rotating in forward and reverse directions and a first rotatable member 3*m*, and then discharged onto the discharge tray 6 by a forward rotation of the conveying roller 3*g* and a forward rotation of the discharging roller 3*h*.

On the other hand, in the case where an image is formed on both sides, the discharge roller 3*h* conveys a sheet S toward the discharge tray 6 by a forward rotation thereof, and then reverses the direction of rotation after the trailing edge of the sheet S passes the conveying roller 3*g*. Here, when the trailing edge of the sheet passes the conveying roller 3*g*, the trailing edge goes toward the side of a second rotatable member 3*n* owing to rigidity (stiffness) thereof. Further, when the discharge roller 3*h* makes a reverse rotation in such a state, the trailing edge of the sheet S enters a nip between the conveying roller 3*g* and the second rotatable member 3*n*, and is sandwiched between the conveying roller 3*g* and the second rotatable member 3*n*.

In addition, when the sheet S is sandwiched between the conveying roller 3*g* and the second rotatable member 3*n* like this, the conveying roller 3*g* is in a reverse rotation, whereby the sheet S passes through a re-conveying path 18 of the duplex unit 10, and a skew feed thereof will be corrected by the pairs of the oblique-feed rollers 11A and 11B. Then, thereafter, through an intermediate roller 3*d*, the sheet S is fed to the image forming portion 51 again, formed with an image on the second side of the sheet S at the image forming portion 51, and subsequently stacked on the discharge tray 6 by the discharge roller 3*h*.

Figure 2:
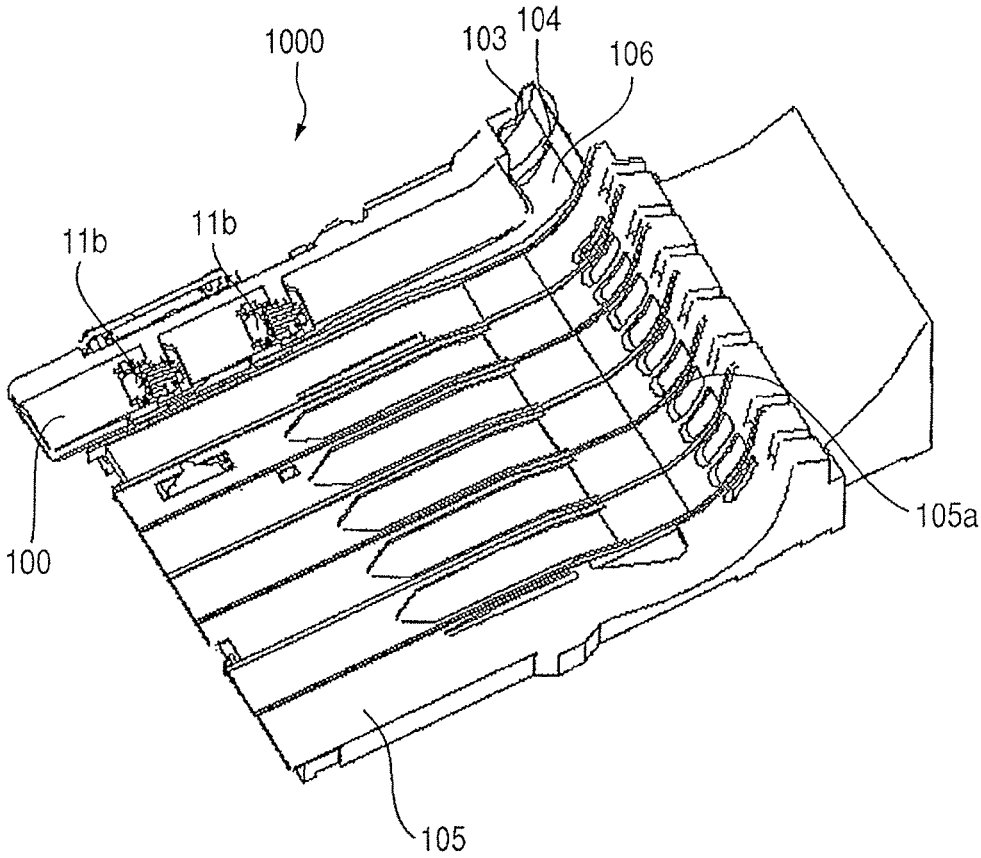
FIG. 2 is a perspective view illustrating a construction of a duplex unit, being the above-mentioned sheet conveying apparatus.
Figure 3:
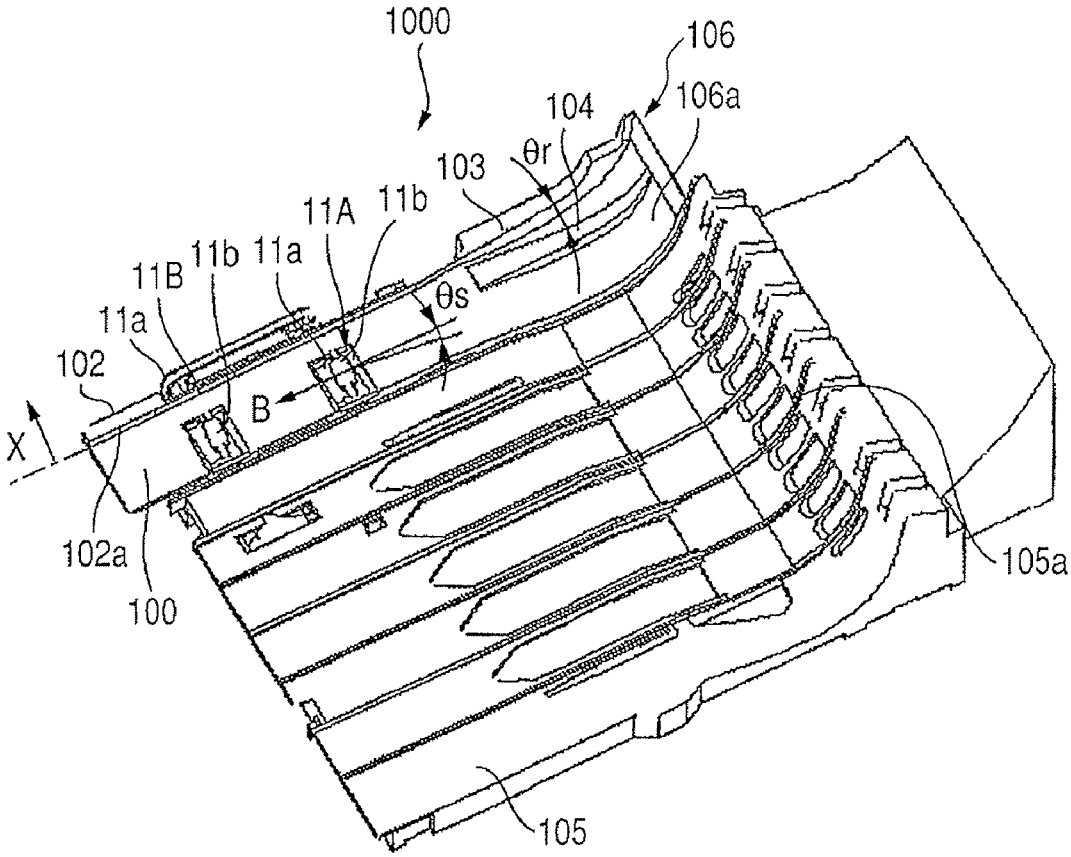
FIG. 3 is a perspective view illustrating a lateral registration correction unit disposed in the above-mentioned duplex unit.

Incidentally, the duplex unit 10, being a sheet conveying apparatus, as illustrated in FIGS. 2 and 3, is provided with a lateral registration correction unit 1000, being a skew feed correction unit including the pairs of oblique-feed rollers 11A and 11B as an oblique-feed mechanism, a reference member 100 as a holding member holding the pair of oblique-feed rollers 11A and 11B. In addition, FIG. 3 is a view illustrating the state in which a part of the reference member 100 illustrated in FIG. 2 is cut away.

At one end portion in a width direction orthogonal to a sheet conveying direction indicated by the arrow B of the reference member 100, there is provided a reference guide 102 against which at the time of passing the re-conveying path 18 (refer to FIG. 1), a sheet is pressed by the pairs of oblique-feed rollers 11A and 11B to perform the positioning of the sheet in a width direction of the sheet. Furthermore, the pairs of the oblique-feed rollers 11A and 11B include oblique-feed rollers 11*a* and oblique-feed rotatable members 11*b* obliquely press-contacted by a spring (not shown), having an oblique-feed angle θs with respect to the oblique-feed rollers 11*a* as illustrated in FIG. 4.

Figure 4:
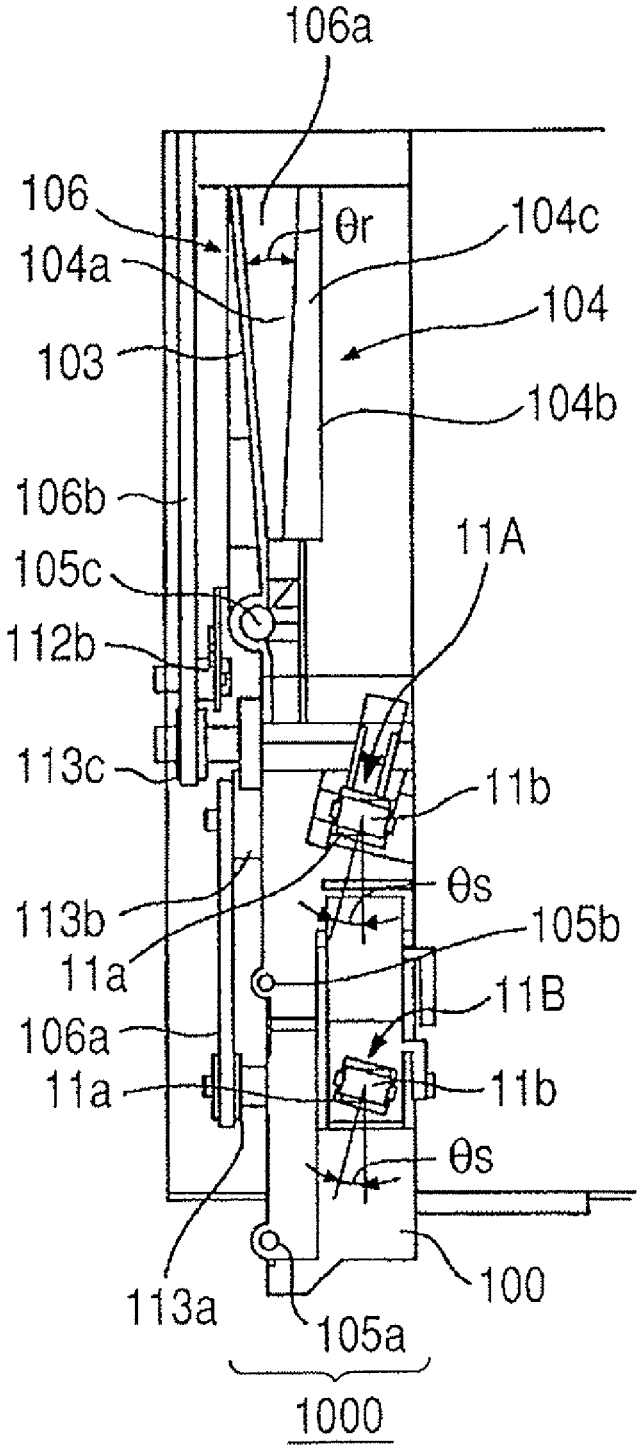
FIG. 4 is a view of the above-mentioned lateral registration correction unit looking from above.

In addition, in FIG. 4, the pairs of the oblique-feed rollers 11A and 11B are driven by a sheet re-feed motor (not shown) via timing belts 106*a* and 106*b* and pulleys 113*a* to 113*c*. Moreover, the lateral registration correction unit 1000 is provided movably in the width direction of a sheet to be conveyed depending on the size of the sheet of which a skew feed is to be corrected, and has preliminarily been moved in a position based on the size of the sheet to wait for the sheet coming.

Furthermore, the pairs of the oblique-feed rollers 11A and 11B that are constructed like this and held by the reference member 100 causes a sheet having been conveyed by the conveying roller 3*g* that is provided on the upstream of the lateral registration correction unit 1000 to come close to the reference guide 102.

In addition, thereafter, the position in a width direction of a sheet S is registered with a reference line obtained by connection of reference pins 105*a* to 105*c*, and the sheet S is conveyed in this state to the conveying roller 3*d* provided on the downstream of the lateral registration correction unit 1000. Furthermore, these reference pins 105*a* to 105*c*, since a reference surface 102*a* extended in a sheet conveying direction is formed in a mold, is provided to prevent this reference surface 102*a* from being scraped with the end portion of the sheet to be pressed thereto.

In addition, as illustrated in FIG. 4, there are provided on the upstream of the reference member 100, a sheet introducing portion 106 and a rib (protrusion) 104 as a guide portion. This sheet introducing portion 106 is formed with a sheet introducing portion side end 103 forming a guide surface of a sheet S. This sheet introducing portion side end 103 has a rake angle from a direction of going away from the central portion to a direction of coming near to the central portion in the sheet conveying direction. That is, the sheet introducing portion side end 103 is oblique toward the central portion in a width direction orthogonal to the sheet conveying direction of the re-conveying path 18.

Whereby, in the case where a sheet is conveyed being deviated in the X direction of a width direction illustrated in FIG. 3, the sheet is conveyed while changing the direction of a sheet end portion to the −X direction of the width direction with the rake angle of the sheet introducing portion side end 103 of this sheet introducing portion 106. In addition, here, the X direction stands for a direction toward the outside of the lateral registration correction unit 1000, and the −X direction stands for an opposite direction to the X direction.

Note that, in FIG. 2, a conveying lower guide 105 is located in parallel with the reference member 100, and forms a lower surface (bottom surface) of the re-conveying path 18. A conveying surface lower surface 105*a* of this conveying lower guide 105 is substantially flush with a conveying path lower surface 106*a* of the sheet introducing portion 106.

The rib 104 forms a sheet conveying surface of the reference member 100. Further, a side end (hereinafter referred to as a rib side end) 104*a* on the sheet introducing portion 106 side of this rib 104 has a gradient θr, as illustrated in FIG. 4, with respect to the sheet introducing portion side end 103, and has a gradient of coming near the sheet introducing portion side end 103 from upstream to downstream. That is, in this embodiment, an upper surface 104*c* of this rib 104 has a suitable shape of coming wider in a downstream direction.

Incidentally, a side end 104*b* on the opposite side (hereinafter referred to as an opposite side end) to the side end 104*a* of this rib 104 is disposed in parallel with respect to the reference guide 102. In addition, this rib 104, as illustrated in FIG. 3, is a protruding surface with respect to the conveying path lower surface 106*a* of the sheet introducing portion 106 and the conveying surface lower surface 105*a* of the conveying lower guide 105.

Now, operations of a rib 104 of such construction are described.

Figure 5A:
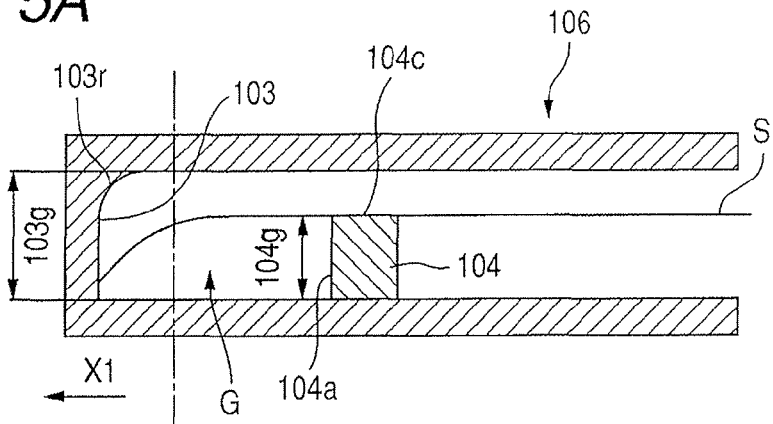
FIGS. 5A, 5B and 5C are diagrams illustrating movements of a sheet when the sheet is conveyed in the state of being deviated in a thrust direction to a sheet introducing portion provided in the above-mentioned lateral registration correction unit.
Figure 5B:
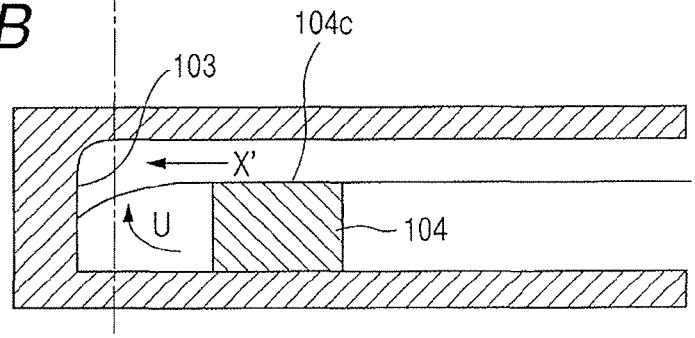
Figure 5C:
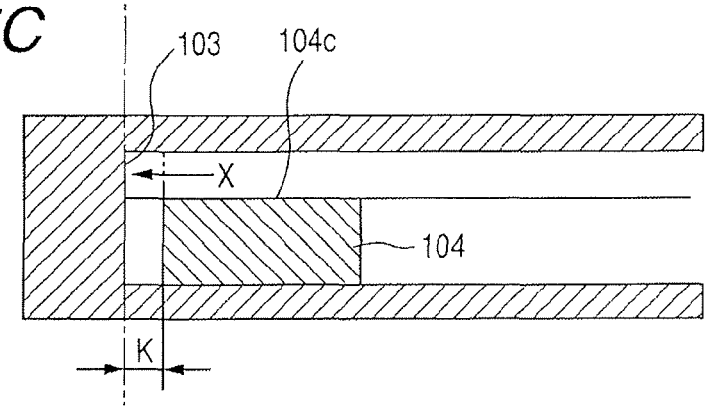

FIGS. 5A, 5B and 5C are schematic diagrams viewed from the downstream of the reference member 100 illustrating the movement of a sheet S when the sheet S is conveyed to the sheet introducing portion 106 being deviated a deviation amount X1 in a thrust direction with respect to the reference guide 102. Incidentally, FIG. 5A illustrates a cross section on the upstream of the sheet introducing portion 106, FIG. 5C illustrates a cross section on the downstream thereof, and FIG. 5B illustrates a cross section at the portion therebetween. In FIG. 5A, a space G is formed between the sheet introducing portion side end 103 and the rib 104.

Figure 10:
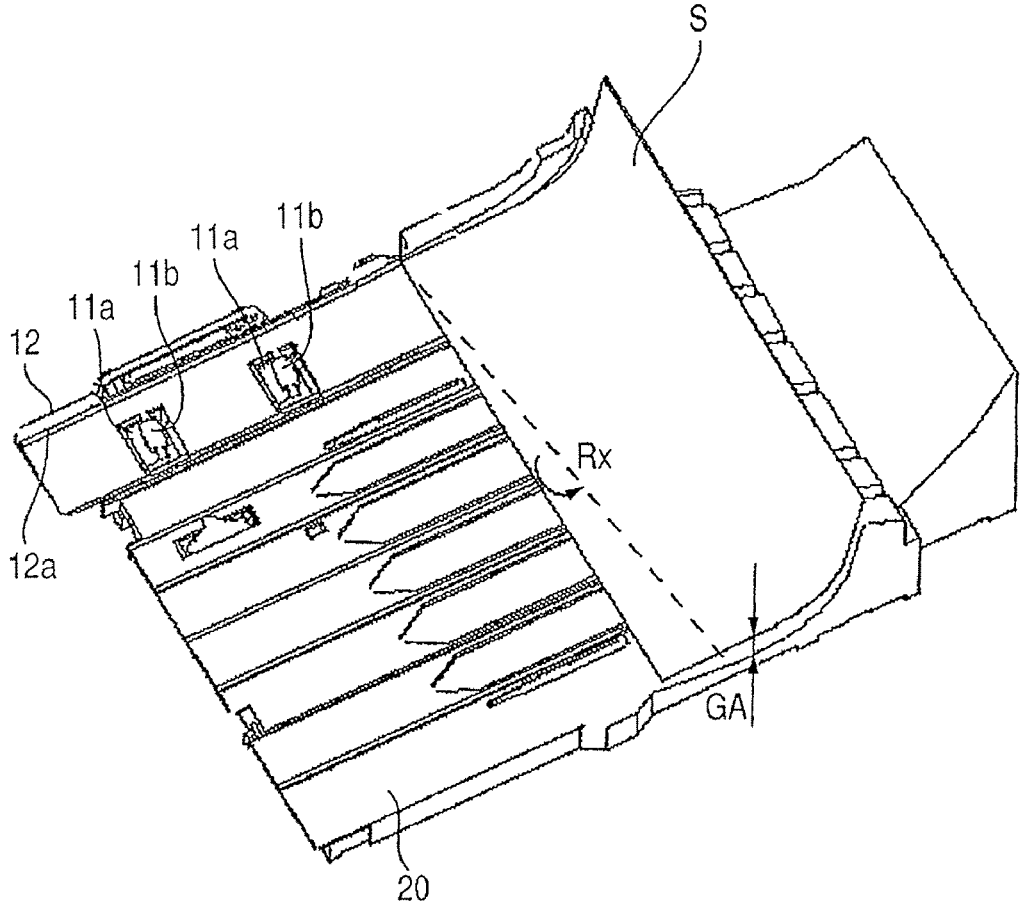
FIG. 10 is a perspective view illustrating the construction of the re-conveying path of the conventional sheet conveying apparatus.
Figure 11:
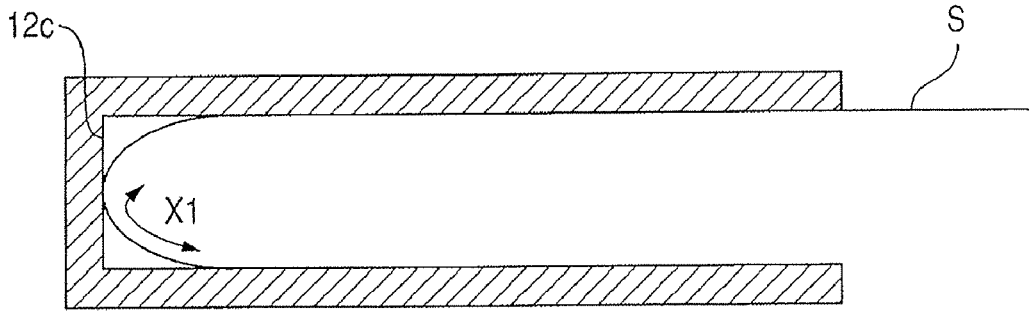
FIG. 11 is a diagram illustrating the state in which a sheet having been conveyed being deviated is buckled in the conventional sheet conveying apparatus.

Here, as illustrated in FIG. 5A, a corner portion 103*r* between a conveying surface upper surface of the sheet introducing portion 106 and the sheet introducing portion side end 103 is rounded (corner portion is formed to be circular arc surface-shaped). Whereby, when a sheet S is conveyed to the sheet introducing portion 106 being deviated by a deviation amount X1 in a thrust direction, the leading edge of the sheet S is rotated in the thrust direction and the sheet S is twisted, and the leading edge portion of the sheet S on the opposite side to the reference guide 102 is flexed in a gap GA (refer to FIG. 10).

Then, when the sheet S is twisted and the leading edge portion of the sheet S is flexed in the gap GA, the rigidity of the sheet gets higher by degrees, a contact force between the leading edge on the sheet introducing portion side of the sheet S and the sheet introducing portion side end 103 gets larger. Then, the leading edge of the sheet S is contacted with the corner portion 103*r* to be guided downward with the circular arc surface of this corner portion 103*r*.

At this time, by a sheet S being guided along the upper surface 104*c* of the rib 104, since the rigidity on the sheet introducing portion side of the sheet S gets higher, the rigidity of the sheet S is maintained at such a level as to prevent buckling, and thus the leading edge of the sheet S is slid along the sheet introducing portion side end 103.

That is, even if the leading edge portion of the sheet S on the opposite side to the reference guide 102 is flexed in the gap GA, and thus the rigidity of the sheet S gets higher, due to that the rigidity on the sheet introducing portion side of the sheet S gets higher, the sheet S is not buckled, but rotated in a thrust direction. Note that, the larger a height 104*g* of this rib 104, the more the sheet end portion can be flexed downward; so that even if the deviation amount X1 in the thrust direction of the sheet S is increased, correction can be made.

Thereafter, when the sheet S is conveyed further along the sheet introducing portion side end 103, as illustrated in FIG. 5B, the rib side end 104*a* of the rib 104 comes near to the sheet introducing portion side end by the gradient θr, and thus the space between the rib 104 and the sheet introducing portion side end 103 becomes smaller.

Owing to that this space becomes smaller like this, the end portion of the sheet is lifted in the direction indicated by an arrow U by the upper surface 104*c* of the rib 104, and thus the rigidity of the sheet between the rib 104 and the sheet introducing portion side end 103 gets further higher.

Whereby, the amount of flexure in the gap GA of the leading edge portion of a sheet S on the opposite side to the reference guide 102 becomes larger, and thus the rigidity of the sheet S gets larger by degrees as well. Further, the rigidity on the sheet introducing portion side of the sheet S will also get higher with the rib 104. Therefore, without buckling, the sheet S can be rotated stably in the thrust direction.

In addition, the leading edge on the sheet introducing portion side of the sheet S is lifted by the upper surface 104*c* of the rib 104, and in association with this, the sheet S goes ahead while changing its orientation toward the reference guide 102 by degrees.

FIG. 5C illustrates the state in which the sheet end portion having been moved further downstream gets close to the reference guide 102, and there is formed a clearance K between the reference guide 102 and the rib 104. Then, by provision of this clearance K, the leading edge portion on the sheet introducing portion side can be prevented from being caught at the rib 104 in the conveying direction.

Here, as described already, to cause a sheet to rotate in a thrust direction, the leading edge portion of the sheet S on the opposite side to the reference guide 102 needs to be flexed. By provision of such a rib 104, the sheet S can be rotated in the thrust direction without buckling.

Furthermore, when a sheet end portion is lifted in the direction indicated by the arrow U, the sheet end portion is lifted while being contacted with the rib 104, as well as the space between the sheet introducing portion side end 103 and the rib side end 104*a* gradually gets smaller. Whereby, since the sheet S is moved while making the rigidity at the sheet end portion higher, the sheet S can be rotated in the thrust direction without buckling.

Moreover, conventionally, the larger a height 103*g* of the sheet introducing portion side end 103 is, although it is possible to cope with an increase in deviation amount X1 in the thrust direction of the sheet S, the lower rigidity at the sheet leading edge becomes. Accordingly, the sheet is prone to buckle, and as a result, the sheet jam is likely to occur.

By provision of such a rib 104, however, while coping with the deviation amount X1 in the thrust direction of the sheet, and while causing the rigidity at the sheet end portion to be higher with being lifted, the sheet can be rotated in the thrust direction. In addition, a sheet introducing portion side end height 103*g* can be made smaller, and thus the height of the duplex unit 10 and the apparatus main body 54 can be made smaller.

Moreover, in the case of a curled sheet, since lifting in the U direction acts to correct the curled end portion, a sheet jam resulted from a corner folding at the leading edge of the curled sheet can be prevented.

Now, described is the case where a sheet S is conveyed to the reference member 100 being deviated by a distance X2 in a direction of going away from the reference guide 102 (−X direction).

Figure 6A:
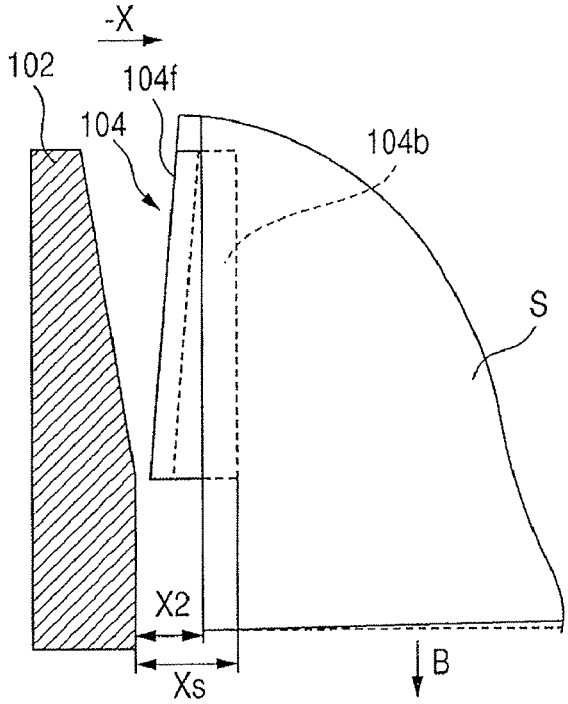
FIGS. 6A and 6B are diagrams illustrating a guide portion provided in the above-mentioned lateral registration correction unit.

FIG. 6A is a view illustrating the state in which the sheet S is conveyed to the reference member 100 being deviated by the X2 in the −X direction indicated by an arrow by the conveying roller 3*g* (refer to FIG. 1). Moreover, according to this embodiment, in the duplex unit 10, in respect of fluctuations in the width direction of the sheet S being conveyed, the amount of being deviated in the −X direction up to Xs is supposed. Further, in this case, the opposite side end 104*b* of the rib 104 is disposed in parallel with respect to the reference surface 102*a* of the reference guide 102 in a position spaced Xs, being the maximum value of deviation amounts, apart from the reference guide 102.

Figure 6B:
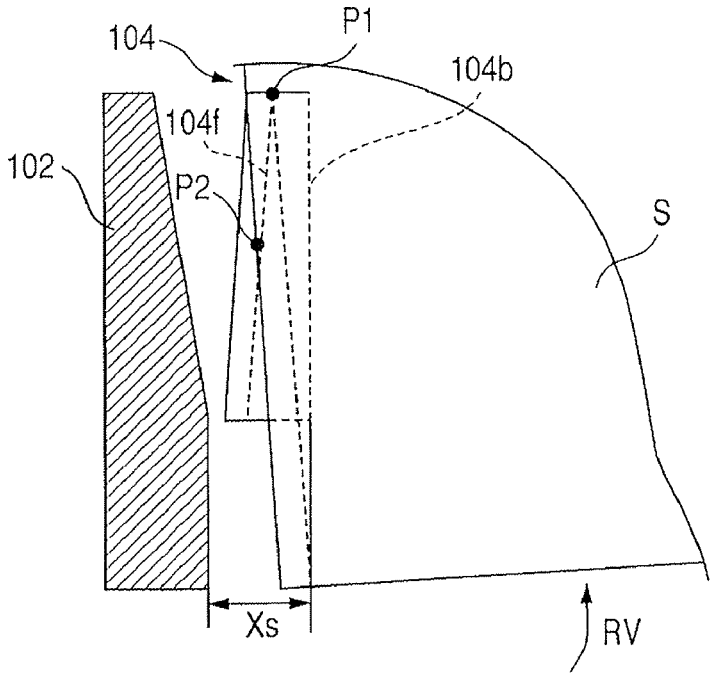

FIG. 6B is a view illustrating the state in which the sheet S is separated from the nip of the conveying roller 3*g* (refer to FIG. 1), and is nipped in the pair of oblique-feed rollers 11A. When the sheet S is released from being caught in the nip of the conveying roller 3*g*, due to that the pair of oblique-feed rollers 11A is disposed in the vicinity of the reference guide 102 in the thrust direction, the sheet is rotated in an Rv direction from the position of the center of gravity of the sheet S.

Here, assuming that the opposite side end 104*b* of the rib 104 is not positioned like this, but is positioned in a position indicated by a reference numeral 104*f* on the reference surface side, that is, in case of being positioned on the reference surface side further than Xs, when a sheet S is rotated in the Rv direction, the rib 104 is contacted with a point P1 of the sheet S, resulting in the occurrence of a sheet jam. Possibly, the sheet cannot be rotated in Rv direction. As a result, the sheet S cannot be pressed against the reference guide 102, and thus the sheet S cannot be positioned in the thrust direction.

Moreover, depending on a deviation amount in the −X direction of a sheet S, although a sheet side edge may not be contacted at a point P1, the sheet side edge will be contacted at a point P2 during a rotation. Then, with a contact resistance at that time, the jamming of the sheet S occurs, or the sheet S cannot be rotated in the Rv direction, and thus the sheet S cannot be positioned in the thrust direction.

Accordingly, as with this embodiment, due to that the opposite side end 104*b* of the rib 104 is spaced by Xs apart from the reference guide 102, the occurrence of a sheet jam can be prevented, as well as the positioning in the thrust direction of the sheet can be performed.

Like this, owing to that the rib 104 having the gradient θr is disposed, the leading edge on the sheet introducing portion side of the sheet S is first flexed by this rib 104, and thereafter the sheet end portion is lifted, thereby enabling the sheet S to rotate efficiently in the thrust direction without buckling.

That is, by provision of the rib 104 along the sheet introducing portion side end 103 of the sheet introducing portion 106, there can be formed between the side end 103 and the rib 104 the space G in which the end portion of the sheet S is flexed when the sheet S is in contact with the side end 103. Whereby, the sheet S can be moved while the orientation of the sheet S is changed to the direction toward the reference guide side. As a result, thus, even in the case where the sheet S is conveyed being deviated, the positioning in the width direction of the sheet and the conveyance of the sheet can be reliably made.

Now, a second embodiment according to the present invention will be described.

Figure 7A:
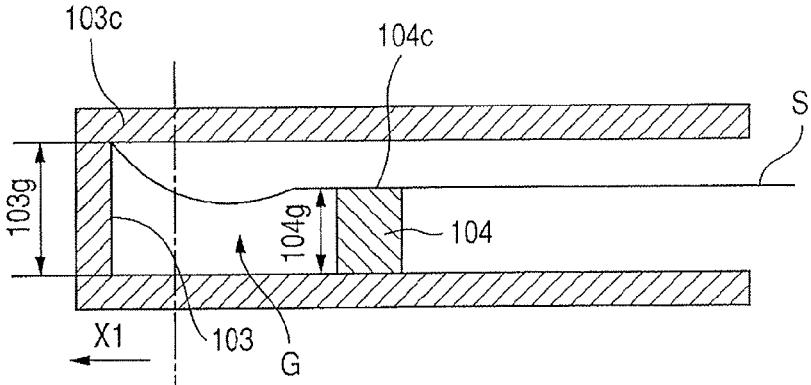
FIGS. 7A, 7B and 7C are sectional diagrams illustrating the construction of a duplex unit, being a sheet conveying apparatus according to a second embodiment of the present invention.
Figure 7B:
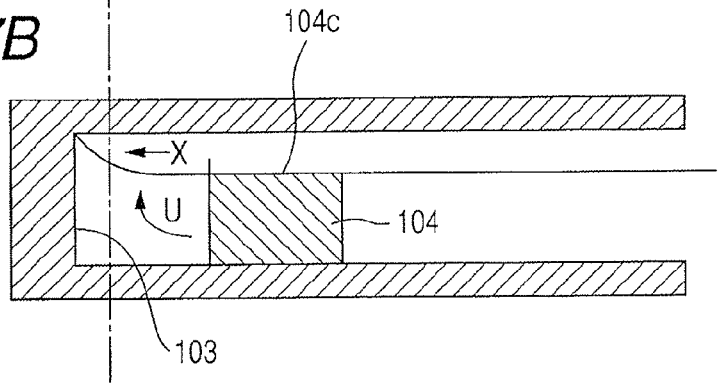
Figure 7C:
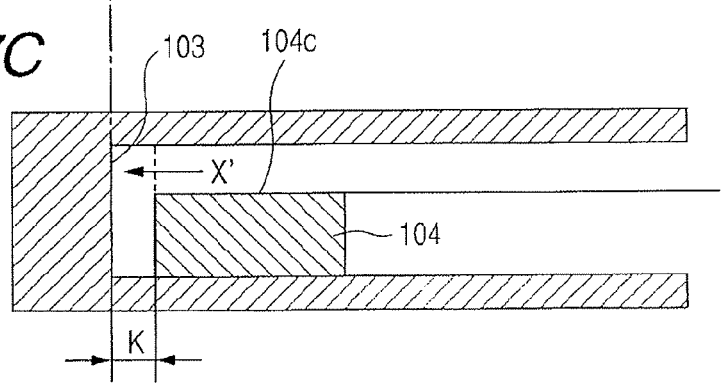
Figure 8:
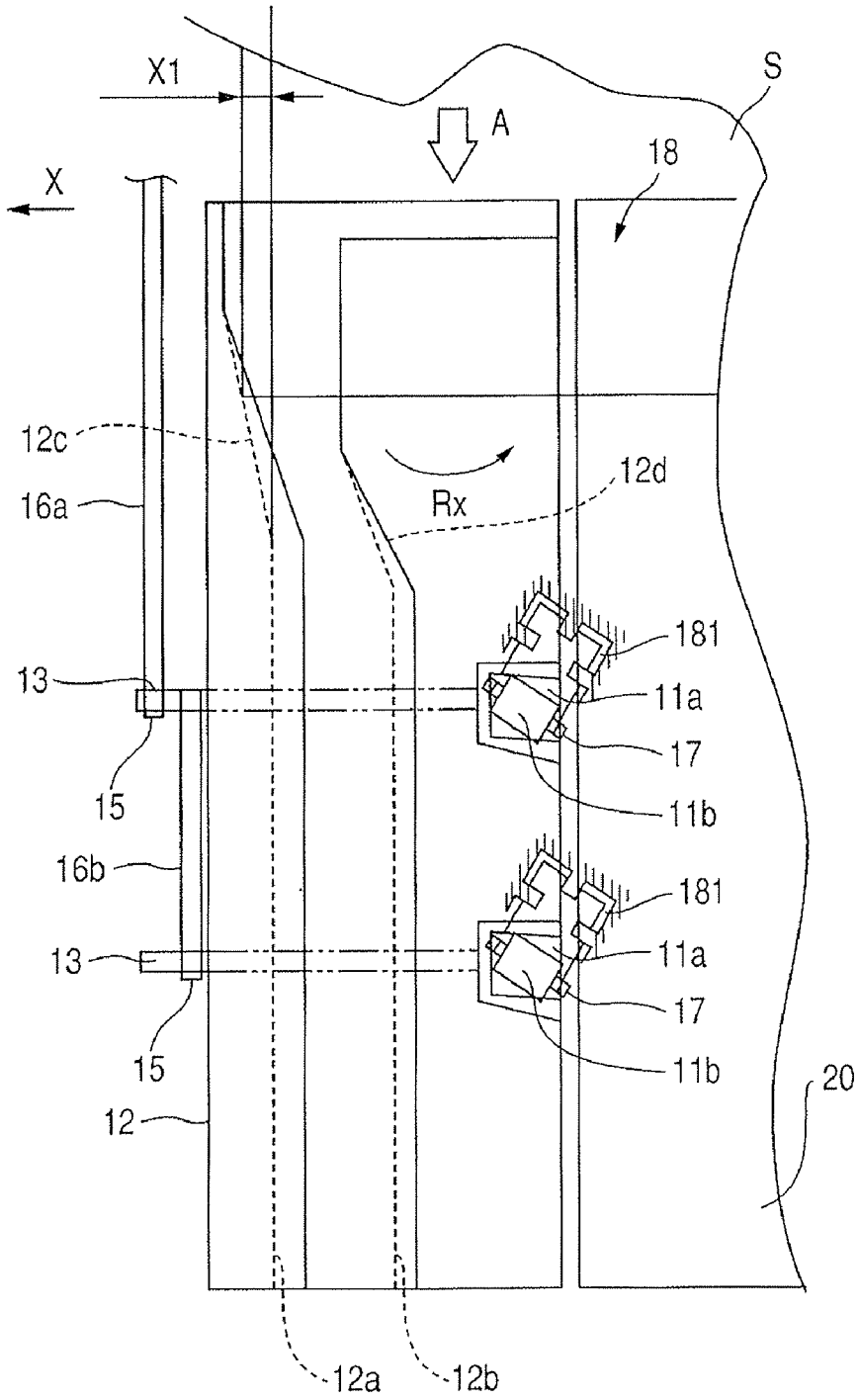
FIG. 8 is a view illustrating the construction of a re-conveying path of a conventional sheet conveying apparatus looking from above.
Figure 9A:
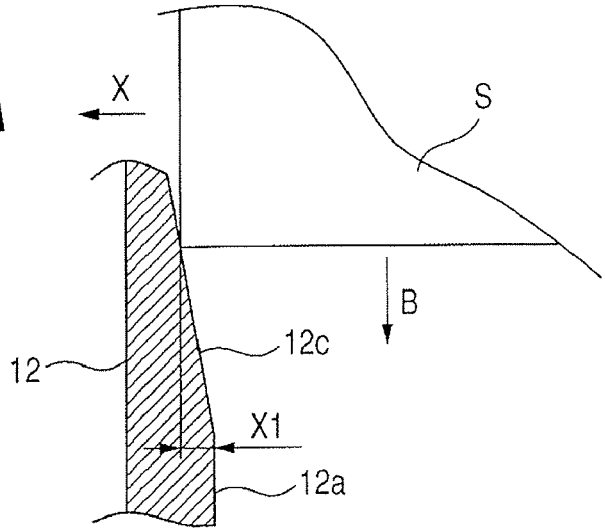
FIGS. 9A, 9B and 9C are diagrams illustrating movements of a sheet when the sheet is conveyed being deviated in the conventional sheet conveying apparatus.
Figure 9B:
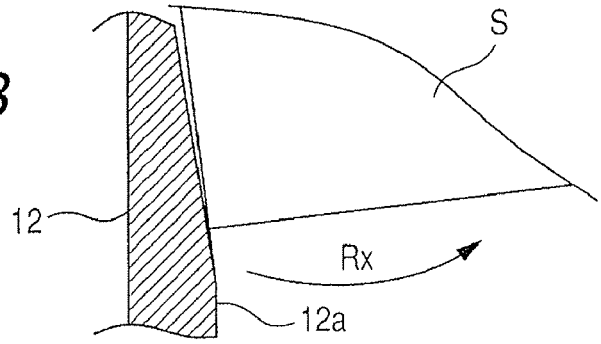
Figure 9C:
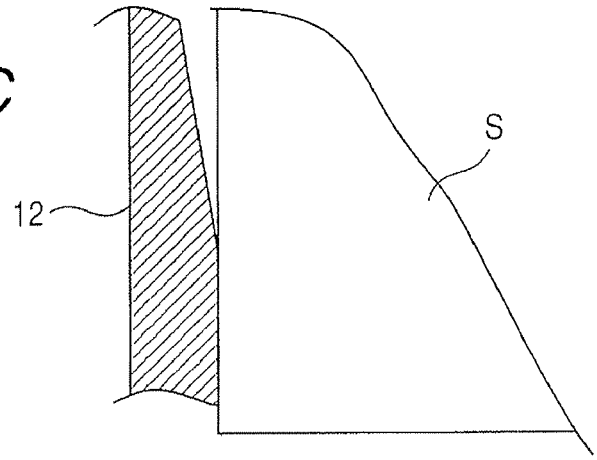

FIGS. 7A, 7B, and 7C are sectional views illustrating the construction of a duplex unit 10, being a sheet conveying apparatus according to this embodiment. Further, in FIGS. 7A to 7C, like reference numerals refer to the same or corresponding parts to those in FIGS. 5A to 5C.

Here, in this embodiment, there is no circular arc surface R at a corner portion 103*c* between the conveying surface upper surface and the sheet introducing portion side end 103.

Moreover, by provision of no circular arc surface R at the corner portion 103*c* like this, when a sheet is introduced to the sheet introducing portion 106, a sheet end portion can be moved in both the direction of the rib 104 and the direction opposite the rib 104 (upper surface direction or lower surface direction). Now, the case where an edge portion of a sheet is guided toward the upper surface is described. Note that, behaviors of the sheet edge portion in the case of being guided toward the lower surface are the same as those in FIGS. 5A to 5C.

In this case, first as illustrated in FIG. 7A, the sheet edge portion is contacted with the corner portion 103*c* between the sheet introducing portion side end 103 and the upper surface, and thereafter the sheet edge portion is flexed toward the corner portion 103*c*. At that time, the larger a sheet introducing portion side end height 103*g* is, the more the sheet edge portion is flexed; so that even if the deviation amount X1 in the thrust direction of the sheet is increased, correction can be performed.

Next, with reference to FIG. 7B, because of being more downward, by the gradient θr, the rib 104 comes proximate to the sheet introducing portion side end 103. Then, due to that the rib 104 comes proximate to the sheet introducing portion side end 103, as compared with the case of FIG. 7A, the space between the sheet introducing portion side end 103 and the rib 104 gets smaller, and in association with this, the sheet edge portion will be lifted in the direction indicated by an arrow U.

Incidentally, FIG. 7C illustrates the state in which the sheet edge portion having been moved more downstream comes close to the reference guide 102, and there is provided a clearance K between the reference guide 102 and the rib 104. In addition, by provision of such a clearance K, a leading edge portion on the sheet introducing portion side can be prevented from being caught at the rib 104 in the conveying direction.

Here, to rotate the sheet in the thrust direction as described above, the leading edge portion of the sheet S on the opposite side to the reference guide 102 has to be flexed. Also in this embodiment, however, as with the first embodiment described above, by provision of the rib 104 having the gradient θr, the sheet S can be rotated in the thrust direction without buckling. Whereby, even in the case where the sheet S is conveyed being deviated, the positioning in the width direction of the sheet, and the conveyance of the sheet can be reliably performed.

Note that, although in the first and second embodiments described heretofore, the rib 104 protrudes from the conveying path lower surface, the rib 104 may protrude from the conveying surface upper surface, or both the upper surface and the lower surface of the conveying surface.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-147173, filed May 26, 2006, which is hereby incorporated by reference herein in its entirety.

What is claimed is:

1. An image forming apparatus comprising:

a reference guide disposed in a conveying path for a sheet, and including a reference surface extending in a sheet conveying direction;

an oblique-feed mechanism configured to oblique-feed the sheet to abut a side edge of the sheet on the reference surface;

a guide surface disposed upstream of the reference guide configured to introduce the conveyed sheet toward the reference guide and the guide surface is oblique so as to come close to a central portion in a width direction orthogonal to the sheet conveying direction of the conveying path as the guide surface extends from upstream to downstream; and a guide portion provided along the guide surface, and disposed so as to come close to the guide surface as the guide portion extends from upstream to downstream, wherein the guide surface is connected with an upper surface and a lower surface to be laterally-facing substantially U-shaped in cross section, and a circular arc surface is formed at a corner portion between the guide surface and the upper surface.

2. An image forming apparatus according to claim 1, wherein a shape of the guide portion is formed to be wider toward downstream.

3. An image forming apparatus according to claim 1, wherein a length of the guide portion in the width direction is set to be a length enabling the guide portion to contact the conveyed sheet being deviated by a maximum amount to the central portion of the conveying path from the reference surface of the reference guide.

4. An image forming apparatus according to claim 1, wherein the guide portion has a protrusion shape.

5. An image forming apparatus provided with a sheet conveying apparatus reversing a sheet of which one side an image is formed on in an image forming portion, and conveying the sheet to the image forming portion again, the image forming apparatus comprising:

a re-conveying path reversing a sheet and conveying the sheet to the image forming portion again;

a reference guide disposed in the re-conveying path, and including a reference surface extending in a sheet conveying direction;

an oblique-feed mechanism configured to oblique-feed the sheet to abut a side edge of the sheet on the reference surface of the reference guide;

a guide surface disposed upstream of the reference guide configured to guide the conveyed sheet toward the reference guide and the guide surface is oblique so as to come close to a central portion in a width direction orthogonal to the sheet conveying direction of the re-conveying path as the guide surface extends from upstream to downstream; and a guide portion provided along the guide surface, and disposed so as to come close to the guide surface as the guide portion extends from upstream to downstream, wherein the guide surface is connected with an upper surface and a lower surface to be laterally-facing substantially U-shaped in cross section, and a circular arc surface is formed at a corner portion between the guide surface and the upper surface.

6. An image forming apparatus according to claim 5, wherein a shape of the guide portion is formed to be wider toward downstream.

7. An image forming apparatus according to claim 5, wherein a length of the guide portion in the width direction is set to be a length enabling the guide portion to contact the conveyed sheet being deviated by a maximum amount to the central portion of the re-conveying path from the reference surface of the reference guide.

8. An image forming apparatus according to claim 5, wherein the guide portion has a protrusion shape.

* * * * *